United States Patent [19]

Boutin

[11] Patent Number: 4,913,312

[45] Date of Patent: Apr. 3, 1990

[54] SINGLE FOLD TOILET TISSUE DISPENSING CONTAINER

[76] Inventor: L. Jean Boutin, 121 SE. 3rd Ave., #C-608, Dania, Fla. 33004

[21] Appl. No.: 181,012

[22] Filed: Apr. 13, 1988

[51] Int. Cl.[4] ..... B65H 1/00

[52] U.S. Cl. ..... 221/45; 221/59; 248/905; 242/55.2

[58] Field of Search ..... 248/311.2, DIG. 5; 242/55.2; 206/494, 817; 221/45, 46, 49, 52, 56, 58, 59, 279, 282, 283, 155, 199; 312/61

[56] References Cited

U.S. PATENT DOCUMENTS

| | | | |
|---|---|---|---|
| 2,085,479 | 6/1937 | Shaffer et al. | 221/59 |
| 2,087,181 | 7/1937 | Conway | 221/58 |
| 2,122,048 | 6/1938 | Shapiro | 221/45 |
| 2,158,712 | 5/1939 | West | 221/49 |
| 2,533,018 | 12/1950 | Kandarian | 242/55.2 |
| 2,534,169 | 12/1950 | Hope | 221/59 |
| 2,620,153 | 12/1952 | Haskell | 221/46 |
| 2,765,909 | 10/1956 | Graham | 206/494 |
| 2,858,045 | 10/1958 | Loeb | 221/59 |
| 2,905,404 | 9/1959 | Simmon | 242/55.2 |
| 3,095,996 | 7/1963 | Babin | 221/52 |
| 3,145,940 | 8/1964 | Henry | 242/55.2 |
| 3,202,316 | 8/1965 | Silver | 221/59 |
| 3,482,810 | 12/1969 | Bailey | 248/311.2 |
| 3,647,114 | 3/1972 | Bleuet | 221/59 |

*Primary Examiner*—H. Grant Skaggs
*Attorney, Agent, or Firm*—Malloy & Malloy

[57] ABSTRACT

A dispensing assembly specifically designed to individually dispense separate toilet tissue sheets which are collectively disposed on the interior of a dispensing container in a stacked array such that in a preferred embodiment, a biasing means is disposed on the interior of the container and in engaging relation to the stacked array so as to bias an outer end-most one of the tissues in accessible relation to an exit structure formed in the container and further wherein a mounting assembly is secured to the container so as to allow it to be removably mounted on a conventional toilet tissue roll supporting structure found in most bathrooms.

11 Claims, 4 Drawing Sheets

SINGLE FOLD TOILET TISSUE DISPENSING CONTAINER

BACKGROUND OF THE INVENTION

1. Field of the Invention

This invention relates to a dispensing device for individual sheets of toilet tissues which is specifically structured to include a container for the tissues. The container is also designed to be removably mounted within a conventionally structured and disposed toilet roll mounting structure or facility.

2. Description of the Prior Art

The use and packaging of individual tissues most commonly referred to as facial tissue, as been known to the consuming public for many years. Similarly, numerous types of containers or dispensing assemblies have been developed and exist in the prior art which are specifically directed to the containment and the dispensing of the individual tissue sheets. Such dispensing containers typically allows the user to remove any number of such individual tissues one at a time in a manner which readily makes the next most adjacent tissue readily positioned for removal from the contained tissue group.

To the contrary, tissues commonly known as toilet tissue are typically available to the consuming public and used thereby in "roll" form wherein individual sheets are readily separable from one another but are collectively presented and packaged in a roll configuration. Attendant dispensing facilities associated with the support and dispensing of such roll-type toilet tissue ar found in almost every home and most commercial or public bathroom facilities. While the utilization and dispensing of toilet tissue in the roll configuration is of course operable and well accepted by the public, it is easily recognizable as being more economical to dispense toilet tissue individually in sheets in a manner generally similar to the dispensing of facial tissues, as set forth above. However, few if any prior art structures lend themselves specifically to the mounting of a dispensing container for the containment and packaging of the individual sheet so that such container may be adapted to conventional roll supporting structures of the type found in most bathroom facilities.

By way of representation of typical prior art structures, the following U.S. Patents are representative of the individual tissues from a contained stacked array.

Spiegelberg, U.S. Pat. No. 4,181,225, discloses the dispensing of wet tissue packs or cleansing tissues arranged in a stacked array from the interior of a box-like container. Similarly, Cassia, U.S. Pat. No. 4,058,235, discloses a dispenser for the containment and disbursal of interleaved sheets of tissue. Fine, Des. U.S. Pat. No. 2,842,247, represents a design of a tissue dispenser structure which apparently may be wall-mounted due to the existence of adhesive on a rear surface thereof.

Shimada, U.S. Pat. No. 3,982,685, discloses a method and device for separating carton layers to open a closed-type carton container and therefore is primarily directed to the formation of a dispensing opening through which contained tissues are in fact removed from the interior of the container. Similarly, Masui, U.S. Pat. No. 4,574,952, discloses a box-type container for facial tissues having a similar simply disposed and readily accessible opening initially covered by a weakened segment tongue or flap. Also similar is the structure disclosed in the patent to Wyant, U.S. Pat. No. 4,681,240, directed to a toweling package comprising a stack of folded or interleaved paper towels and a plastic wrapper enclosing such towels.

Goebel et. al, U.S. Pat. No. 3,940,054 and Hein, III et al. U.S. Pat. No. 4,200,200 both disclose tissue cartons wherein tissues are dispensed through an accessible opening independent of one another.

The patent to Mallow, U.S. Pat. No. 4,513,862, discloses a scented tissue dispensing container including a dispensing box in which the supply of tissues are contained having a closure structure specifically adapted for the dispensing of scented tissue.

SUMMARY OF THE INVENTION

The present invention is directed towards a dispensing container specifically for individual sheets of toilet tissue wherein the consistency and/or density or the material from which the tissues are formed, while commercially available, renders them efficient for toilet tissue use. Therefore, the dispensing of the tissue material in individual sheet form as versus from a roll-type configuration, provides a more economical means providing user with toilet tissue since in effect less tissue will be used.

The present invention is directed towards a dispensing assembly including a primary container used to package and contain a plurality of tissues of sufficient density and structure to be used as toilet tissue and individually separable from one another but collectively disposed in a stacked array on the hollow interior of the container. A biasing means is used in cooperation with a support platform itself disposed beneath an inner or under mot one of the facial tissues of the stacked array such that the stack of tissue is effectively supported thereon. The biasing means is disposed between an inner surface of the base of the container and an under portion of the support platform and includes at least one but in certain embodiments, a plurality of spring elements or members disposed and constructed to normally bias a stacked array towards an exit means.

The exit means, in a preferred embodiment is a aperture disposed in an end wall opposite to the base of the container wherein the exit aperture is specifically configured to allow passage, individually, of the tissues therefore. The tissues, as is well-known in the art, may be interleaved so that removal of one tissue will automatically force the next adjacent inner tissue up into exposed and accessible relation to the exit aperture.

An important feature of the present invention is the existence of mounting means formed either on the exterior of oppositely disposed side walls of the containment or in another embodiment to be described in greater detail hereinafter, on the sides of a decorative housing wherein the aforementioned container represents a replacement container to be mounted within the housing.

In either embodiment, the mounting means includes preferably two mounting members disposed in the aforementioned position and specifically structured to engage the apertures or sockets or outwardly extending arms found in virtually all roll supporting structures in domestic, commercial or publicly available toilets. Such roll supporting structures are typically disposed and designed to hold a roll of toilet paper on a supporting roller wherein the ends of the roller are engaged within the aforementioned receiving sockets of the arms of the roll supporting structure. The roller, typically, is removably mounted in such a position so as to replace toilet rolls when the supply of tissues thereon is exhausted.

Accordingly, the mounting means including the two mounting members, one on each side of each of the container or a housing for a replacement container, are disposed, structured and coaxially aligned in registry with the roll supporting structures such that the mounting members are specifically allowed to be removably engaged within the socket and thereby removably serving to support the container and/or the housing in the same roll supporting facility in current use in virtually all toilet facilities.

Naturally, it is well-accepted that the dimensions, configurations and overall designs of such roll supporting structures varies and accordingly, the mounting means including the various mounting members are provided herein in numerous embodiments. These embodiments allow either for adjustable positioning of the mounting member relative to the dimension of the supporting roll or are specifically configured and are appropriately dimensioned to be received in roll supporting structures of various dimensions.

While the container of the present invention is normally found in an upright position such that the exit aperture formed therein is disposed in an upper exposed end wall of the container when operatively mounted in the roll supporting structure, another embodiment contemplates a reversed orientation to such upright disposition. More specifically, in one embodiment to be described in greater detail hereinafter, the exit aperture is formed in a bottom oriented end wall such that the stack of toilet tissues are directed towards the exit aperture by gravity rather than through the existence of any type of biasing means or support platform therefore.

The invention accordingly comprises the features of construction, a combination of elements, an arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 7:
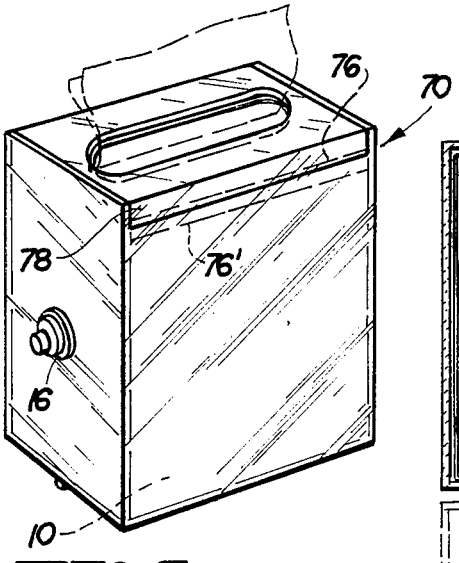
FIG. 7 is a perspective view of the housing structure of the present invention enclosing the container of FIG. 1.

With reference to FIGS. 1 through 4, the present invention is directed towards a dispensing assembly including a container generally indicated as 10 specifically configured and structured to fit within virtually any type of conventional roll supporting structure generally indicated as 12. The typical roll supporting structure is normally wall mounted or mounted on a wall surface of any toilet stall or the like and includes outwardly extending arms 14 each having a socket or like recess portion 15 formed therein for the receipt of the ends of a removable supporting roller (not shown for purposes of clarity). As will be explained in greater detail hereinafter, the container 10 of the present invention incorporates mounting means which, shown in FIG. 1, includes two mounting members 16 secured to the exterior surface of oppositely disposed side walls 17 of the container 10. With reference to FIGS. 18 through 20a, various embodiments of the individual mounting members 15 (see FIG. 1) are represented therein. The plurality of different structures representing such different embodiments are provided such that the container 10 may be readily adaptable to any commonly used size of roll supporting structure 12 and more specifically be adapted to removably support or mount the container 10 (or the housing as shown in FIG. 7) between and within the spaced distance of the arms 14 and the individual configuration or dimension of the respective roll receiving sockets 15 formed in the inner surface of such arms 14.

Figure 1:
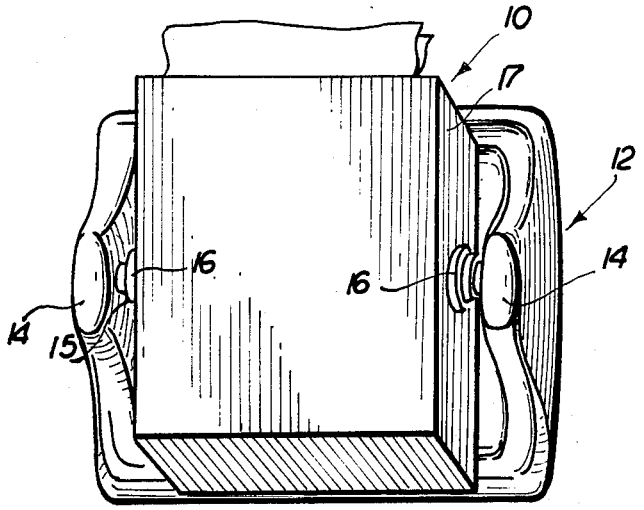
FIG. 1 is a perspective view of a container of the present toilet tissue dispensing assembly mounted on a conventional roll supporting structure.
Figure 18:
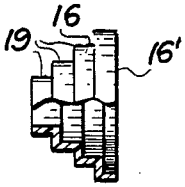
FIG. 18 is a side view in partial cut-away in section of a mounting member of the present invention.

For example, FIG. 18 represents the embodiments shown in FIG. 1 wherein each mounting member 16 has an inner end portion 16' which may be adhesively or otherwise secured directly to the exterior surface of the opposed side wall 17 of the container 10. The outer surface is disposed in a plurality of staggered steps 19 of progressively greater dimension. These various steps, all being of different size, is therefore readily adaptable to the various diameters or other configural dimensions of the sockets 15 as described with reference to FIG. 1.

Figure 19:
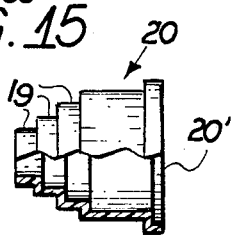
FIG. 19 is a side view in partial cut-away in section of another embodiment of a mounting member of the present invention.

FIG. 19 shows the mounting structure 20 in different embodiment format wherein the base 20' is readily secured to the side wall 17 of FIG. 1 and further wherein, such mounting member 20 has a greater longitudinal dimension so as to extend outwardly farther from the end wall 17. Again, the various stepped configurations of varying dimensions are provided for the reasons set forth with regard to the discussion of the embodiment of FIG. 18.

Figure 20:
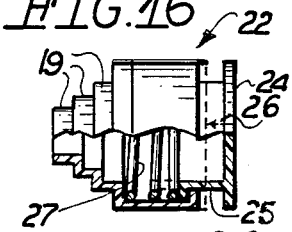
FIG. 20 is a side view in partial cut-away in section of yet another embodiment of the mounting structure of the present invention.

The embodiment of FIG. 20 is represented as 22 and differs from the embodiment of FIGS. 18 and 19 in that the base portion 24 extends by virtue of an inwardly projecting member 25 into the interior of the remainder of the mounting member 22 and is there biased by a spring element 27 as clearly shown in FIG. 20. It should be readily apparent that once the base 24 is secured in the manner shown in FIG. 1 as is mounting member 16 therein, that the plurality of stepped exterior surfaces 19 are adjustably but selectively positionable so as to be readily adaptable to the various spaces between the sockets 15 of the supporting arms 14. It is clear that the base 24 and the inwardly projecting member 25 is movable relative to the remainder of the mounting member 22 but is normally biased in an outwardly extended position as represented in solid lines in FIG. 20. Note directional arrow 26 for the direction of inward movement when forced into the receiving sockets 15.

Figure 20A:
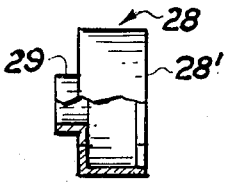
FIG. 20A is a side view in partial cut-away and section of yet another embodiment of the mounting structure of the present invention.

Yet another embodiment is shown in FIG. 20A and generally represented as 28. A single exterior mounted receiving finger 29 is disposed on an outer most end of the mounting member 28 wherein the base 28' is secured to the exterior surface of the oppositely disposed side walls 17. This embodiment differs from the remainder of the embodiments in FIGS. 18 through 20 through the provision of the outer end 29 being designed to be received within a preferably flexible material or any applicable material bushing which itself is removably disposed within the sockets 15. Therefore, the embodiment of FIG. 20A is used wherein an adapter bushing is needed to fill the sockets 15 to the extent of making them effectively small enough such that the bushing itself is secured to the outer projecting end 29 of the mounting member 28 and the flexibility as well as the dimensional configuration of the bushing fitted within the socket 15 is such as to allow it to be frictionally engaged and secured therein but removed therefrom when desired. For purposes of clarity, the bushing per say is not shown but effectively may take any adaptable configuration and dimension.

Figure 3:
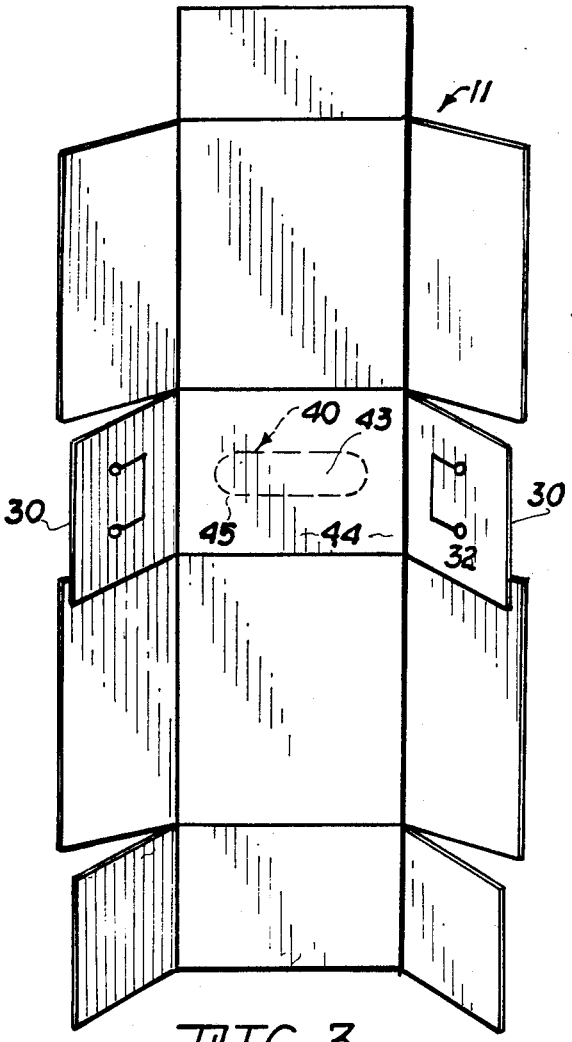
FIG. 3 is a perspective view of a blank, in open, unfolded orientation from which the container of FIG. 1 is formed.
Figure 2:
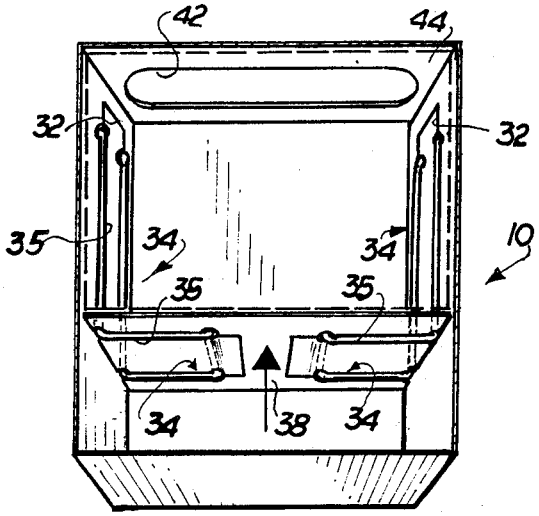
FIG. 2 is a perspective view of the interior of the container shown in FIG. 1 and certain structural components associated therewith.
Figure 4:
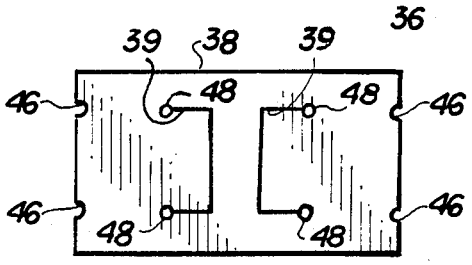
FIG. 4 is a front plan view of the structural details of a support platform associated with the present invention and shown in perspective view in FIG. 2.

With reference to FIG. 3, one embodiment of the present invention shows that the container 10 is formed from a single blank 11 having various creases or fold lines and capable of being folded upon itself to assume the configuration of the container 10. Such fold lines include securement segments 30 including outwardly extendable partially disconnectable flaps 32 defining spaced-apart securement structures of a securement means. The securement means is used to interconnect biasing means generally indicated as 34 in FIG. 2 between the interior surfaces of the container 10 and the support means 36 in the form of a support platform 38 as shown in FIGS. 2 and 4 in detail. The support platform (see FIGS. 5 and 6) is generally disposed beneath a plurality of individual toilet tissues arranged in a stacked array. The biasing means, depending upon the embodiment utilized, serves to interconnect the support platform 38 to the remainder of the container so as to bias it as well as the stacked array 37 of tissues towards the exit means generally indicated as 40 in the form of an exit or access aperture 42 formed in an end wall 44 of the container. The exit aperture 42 is defined by removal of a tongue member 43 (see FIG. 3) along a weakened seam 45 formed in the end wall 44 as shown in both FIGS. 3 and 4.

In the embodiments of FIGS. 2 and 4, the biasing means is in the form of two elastic material bands spaced-apart from one another and having one end removably secured and overlapping in supportive relation by the securement structure in the form of securement flap 32 and the other end connected to the support platform 38 by means of the connecting flaps 39. Appropriately positioned indentations or aperture structures are formed as at 46 and 48 on the support platform 38 to provide for passage and placement of the elastic material bands 35 defining the biasing means 34 of the embodiment of FIG. 2.

Figure 10:
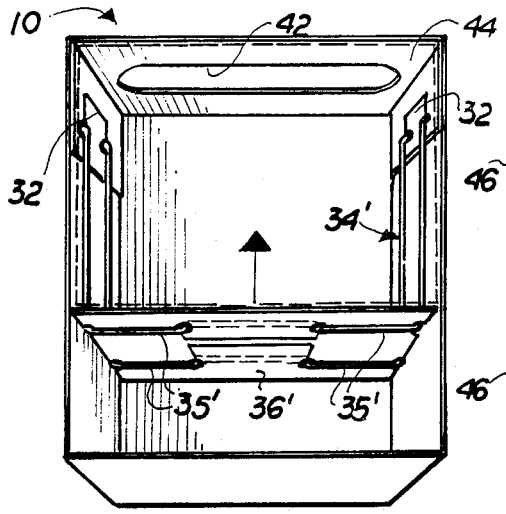
FIG. 10 is another embodiment of the present invention shown in perspective.
Figure 11:
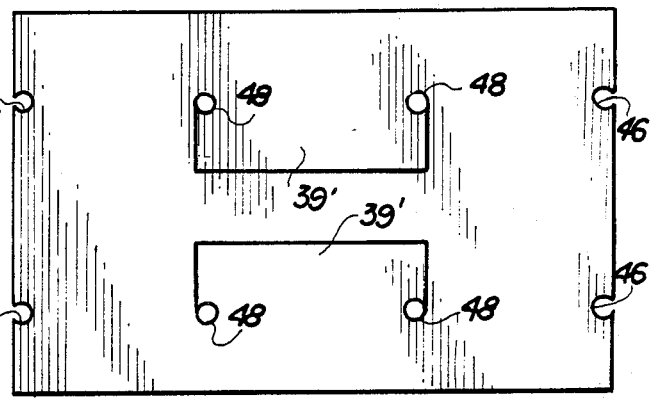
FIG. 11 is another embodiment of the support platform associated with the embodiment of FIG. 10.

With regard to FIGS. 10 and 11, a different embodiment therein comprises the biasing means 34' being defined by a single elongated elastic material band 35' having its opposite ends engaging the two securement flaps 32 as shown in FIG. 10 and being of sufficient length to extend completely across the length of the modified support platform 36' as shown in FIG. 11 wherein inter engagement between the single elastic material band 35' is relative to the support platform 36' as shown in FIG. 10. Appropriate apertures 46 and 48 are formed in the support platform 36' but the connecting flaps 39' are oriented in a different position than that shown in the embodiment of FIGS. 2 and 4. As set forth with regard to the embodiment of FIGS. 2 and 4, two separate spaced-apart flexible material bands 35 were used therein instead of the single elongated elastic material band 34' having a greater longitudinal dimension than either of the bands 35 in FIG. 2.

As explained with regard to the embodiment of FIGS. 2 and 10, the biasing means 34 and 34' respectively were secured to the interior of the container 10 by virtue of the securement flaps 32. However, a variety of securement means may be utilized to secure either the two elastic bands 35 or the single elastic 35' to the interior of the container other than the securement flaps 32. With reference to FIGS. 12 through 17, such plurality of embodiments represented therein are further representative of the various structural differences which may be included in the various securement structures.

Figure 12:
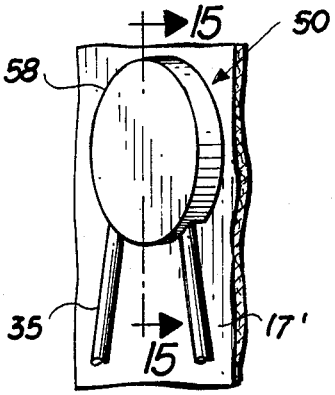
FIG. 12 is a perspective view in partial cut-away of one embodiment of a securement structure of the present invention.
Figure 15:
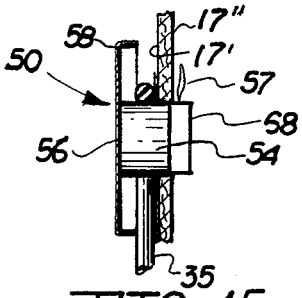
FIG. 15 is a sectional view taken along line 15—15 of FIG. 12.

More specifically, as shown in FIGS. 12 and 15, the securement means may be in the form of two securement structures (one shown for purposes of clarity) and generally represented as 50. Each of the securement structures 50 includes an elongated finger portion 54 having a preferably cylindrical configuration with an inner end extending into the interior of the container as at 56. The inner end includes an enlarged head portion 58 which is spaced from the interior surface of the side wall as at 17'. Accordingly, the elastic band member or the like 35 is supported in partially surrounding relation about the cylindrical finger 54 as shown in FIG. 15. A locking washer or like connector element 57 is provided in surrounding relation to the outer most end 58 and in frictional engagement therewith and in a butting relation to the outer surface 17". The enlarged head 58 prevents or at least reduces the possibility of inadvertent dislodgement of the elastic band biasing member 35 from its supportive position as shown in FIG. 15.

Figure 13:
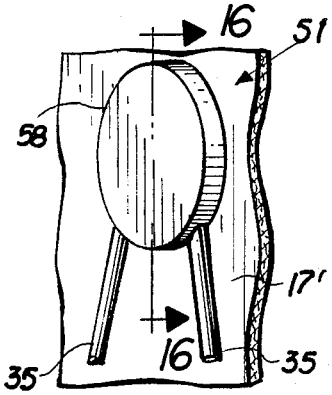
FIG. 13 is a perspective view in partial cut-away of another embodiment of the securement structure of the present invention.
Figure 16:
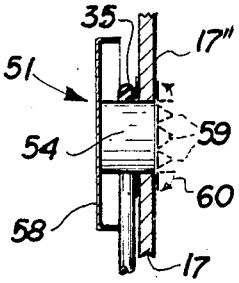
FIG. 16 is a sectional view taken along line 16—16 of FIG. 13.

The embodiment of FIGS. 13 and 16 differ from that of FIGS. 12 and 15 only to the extend that the washer 57 is absent therefrom. Instead, means to attach and connect the securement member 51 comprises a bendable flange preferably formed into a plurality of spaced-apart sharpened teeth members as at 59 which may be bent over in conformance with directional arrow 60 into lockable and even penetrating engagement with the outer surface 17" of the side wall 17.

Figure 14:
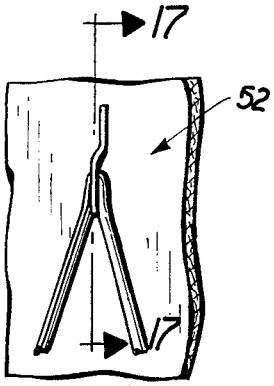
FIG. 14 is a perspective view in partial cut-away of yet another embodiment of the securement structure of the present invention.
Figure 17:
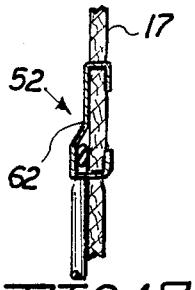
FIG. 17 is a sectional view taken along line 17—17 of FIG. 14.

Yet another embodiment is shown in FIGS. 14 and 17 and represents merely a secured staple or like connector element as at 62 penetrating and lockingly engaging the appropriately positioned side wall 17 of the container 10.

Figure 5:
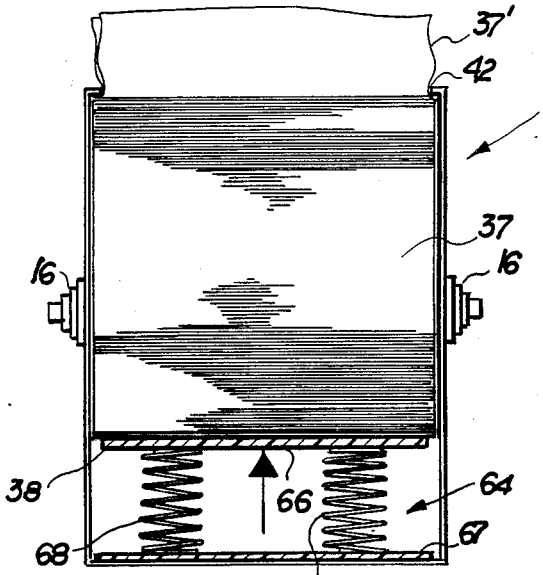
FIG. 5 is a front view in partial section of another embodiment of the support platform and biasing means of the present invention from that shown in FIG. 2.
Figure 6:
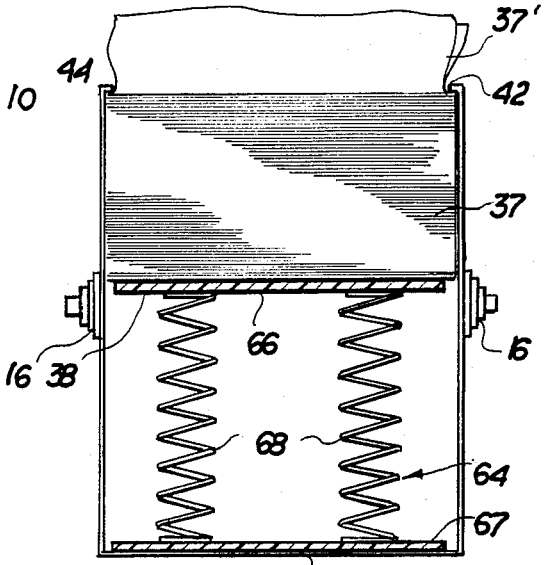
FIG. 6 is a front view in partial section of the structure of FIG. 5 is an alternative position.

With regard to the embodiments of FIGS. 5 and 6, yet another embodiment of the present invention incorporates a variance in the biasing means 64 and the support platform 66. As shown in FIGS. 5 and 6, the biasing means includes at least one but preferably a plurality of spring members 68 which may be coil springs or any other appropriately configured spring structures secured to an inner most bottom end wall as at 67 and an under portion of the support platform 66. In the embodiment shown, the support platform 66 need not have the connecting flaps 39 or 39' as shown respectively in FIGS. 4 and 11 but may be just a planar sheet engaging the inner most end of the stack 37 and serving to bias such stack 37 towards the exit means such that the next adjacent top end most tissue 37' may be readily accessible through the exit apertures 42. At least one but preferably a plurality of springs 68, are normally biased to direct the support platform 66 and the stacked array 37 towards the end wall 44 so as to render the next adjacent single tissue 37' accessible through the exit aperture 42 (see directional arrow in FIG. 5).

Figure 8:
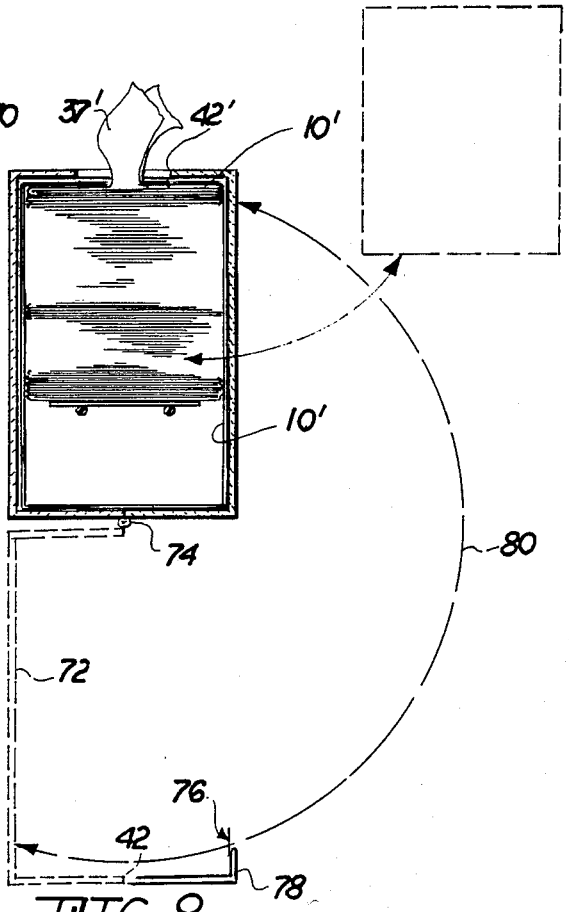
FIG. 8 is a side view in partial section of the housing structure illustrating an open and close position of the front face flap.
Figure 9:
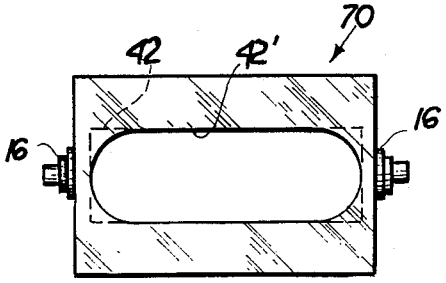
FIG. 9 is a top view of the housing structure of FIG. 7 illustrating the exit means formed in the upper side thereof.

Yet another feature of the present invention includes the container 10 being removably secured to the interior of the roll supporting structure 12 by being mounted within a housing generally indicated as 70. The housing is preferably but not necessarily formed from a clear Lucite or like transparent plastic material. The housing 70 is disposed in totally surrounding relation to the container 10 and is similarly configured. The mounting means in the form of the two mounting members 16 are appropriately placed as shown in FIGS. 7 and 9 so as to allow for removable connection and support by the sockets 15 integrally formed in the arms 14 as described above with regard to the embodiment of FIG. 1. More specifically, the housing 70 includes a pivotally connected front face flap 72 connected to the remainder of the housing by a hinge or appropriate pivotal connector member 74. The interior dimension and configuration of the housing 70 is such as to allow replacement containers 10' similar in structure to that shown in regard to the embodiment of FIG. 1 but absent any connector member 16 secured thereto. An access aperture as at 42' is formed in the upper end in registry with the exit aperture 42 in the container 10' itself. A coupling or like connector preferably in the form of a magnetic strip or coupling member generally indicated as 76 is formed on the inner surface of the end most integral flap 78 in the front face flap 72 and is disposed to register in magnetic attraction and removable engagement with a similarly structured and disposed magnetic mating member 76' as disclosed in phantom lines in FIG. 7. The directional arrow 80 shows the direction of rotation of the front face flap 72 between its open position when replacing the container 10' and its closed position as represented in solid lines in FIG. 8.

Figure 21:
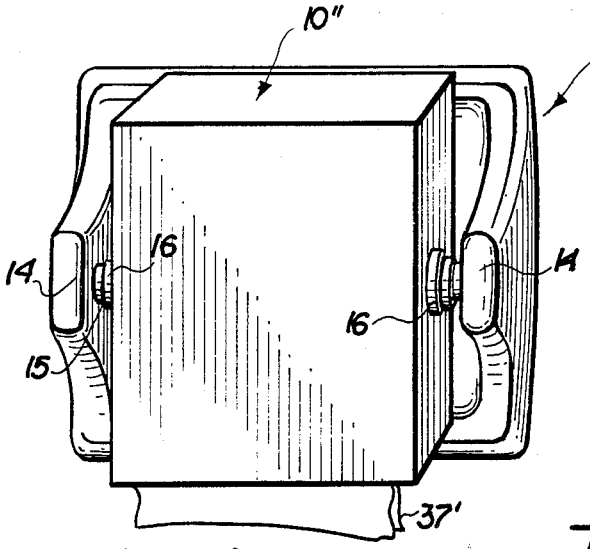
FIG. 21 is a perspective view of another embodiment of the container of the present invention differing somewhat from that of FIG. 1.
Figure 25:
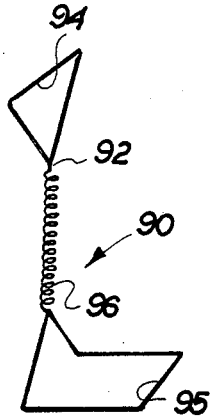
FIG. 25 is a perspective view of a biasing structure associated with the embodiment of FIG. 1.
Figure 22:
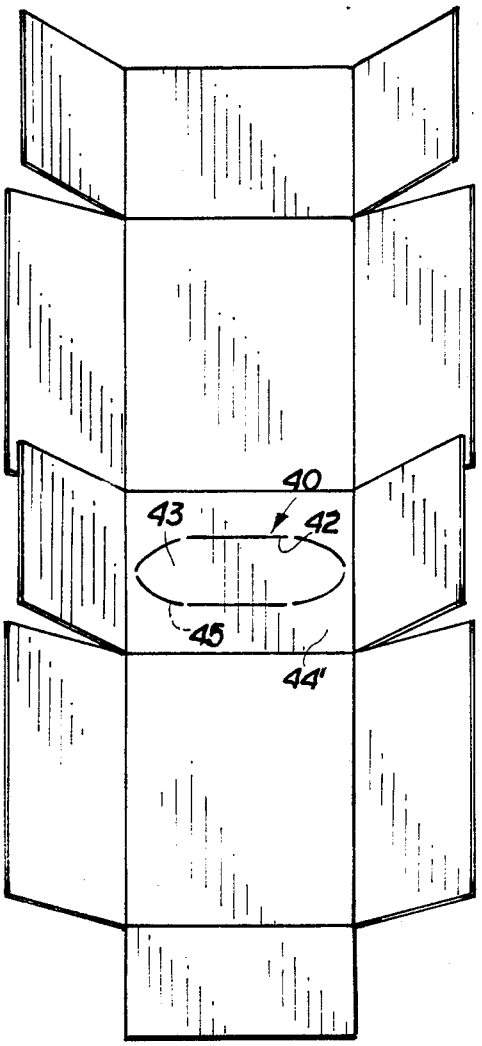
FIG. 22 is a perspective view of a blank from which the container of FIG. 21 is formed.

Yet another embodiment of the present invention is shown in FIG. 21 wherein a conventional roll supporting structure 12 is used to support a container 10' having mounting means in the form of a mounting member 16 disposed on opposite sides thereof and disposed in registry with the supporting arms 14 of the roll supporting structure 12 as they are mounted within the sockets 15. Similarly, the blank of FIG. 22 is similar to the blank of FIG. 3 with the provision that the exit means generally indicated as 40 is formed in the end wall 44' specifically disposed so that the container 10" is oriented, as shown in FIG. 21, in a reverse or up-side-down orientation. Accordingly, each of the individual tissues as at 37' exit the exit or access aperture 42 once the tongue 43 is removed from the end most flap 44' by gravity. Accordingly, no biasing means or support platform are required on the interior of the container 10" since gravity will tend to bias or normally force the stacked tissue towards the exit aperture 42 which is now disposed on the bottom end wall as shown in FIGS. 21 and 22.

Figure 23:
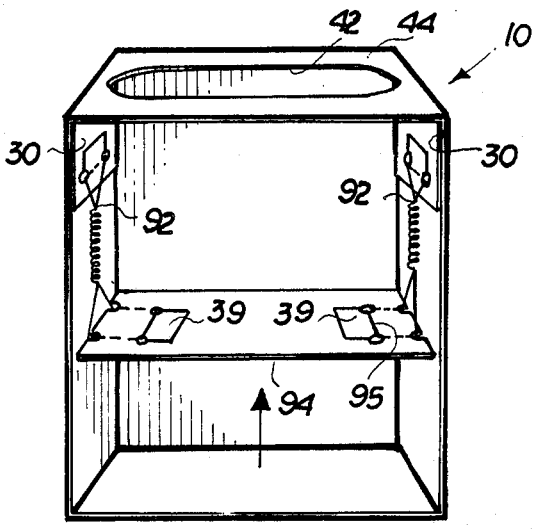
FIG. 23 is a perspective view showing interior structural details of the embodiment of FIG. 1.
Figure 24:
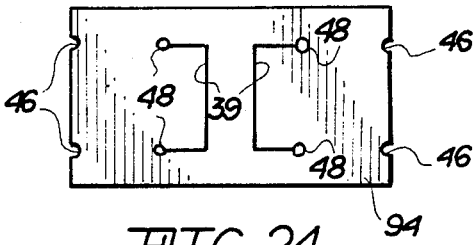
FIG. 24 is a support platform associated with the embodiment of FIG. 23.

Yet another embodiment of the present invention represents another variance or embodiment of the biasing means generally indicated as 90. The biasing means includes two spring elements 92 engaging a support platform 94 and serving to interconnect in a biased relation towards the end wall 44 and the exit aperture 42 formed therein. The structure of the container 10 is the same as shown in FIGS. 1 and 2, and the difference in the embodiment of FIG. 23 being the provision of the two spring members 92 differing from the elastic band embodiment as shown in the above-mentioned figures or the coil springs as shown in FIGS. 5 and 6. To the contrary, the spring members 92 includes opposite ends each having a substantially closed loop configuration respectively as at 94 and 95. The end loop 94 is configured to engage the securement flaps 32 as shown in FIG. 23 and the end loops 95 are configured to engage the connecting flaps 39 as shown. Each of the spring members 92 includes an expandable or extendable member as at 96 may have any spring like configuration allowing for expansion of the entire spring member along its length and contraction thereof so as to provide the proper biasing force on the support platform 94 so as to normally bias the stacked array (not shown for purposes of clarity) towards the exit aperture 42 formed in the end wall 44.

Now that the invention has been described,

What is claimed is:

1. A dispensing assembly for individual folded sheets of toilet tissue designed to be removably mounted on a normally wall mounted toilet roll supporting structure, said assembly comprising:

a. a container including a base, surrounding sidewalls connected to said base and an endwall connected to said sidewalls and oppositely disposed relative to said base, b. said base, sidewalls and endwalls collectively define boundaries of a hollow interior of said container being dimensioned and configured to contain a plurality of the individual tissues disposed in a stacked array, c. exit means formed in said endwall in communicating relation with at least a next adjacent and outer endmost one of the plurality of tissues for removal thereof from said hollow interior, d. A pair of mounting members, each mounted on an exterior of a different oppositely disposed one of said sidewalls in spaced, substantially coaxial relation to one another, said mounting members comprising a stepped outer configuration wherein each step of said stepped configuration comprises a greater traverse dimension than the preceding step, the outer configuration of each mounting member being readily adaptable for receiving sockets on the toilet roll supporting structure, e. support means in transverse relation to said sidewalls engaging the stacked array of said plurality of tissues for at least partial support thereof, f. said support means comprising a support platform disposed in supporting engagement with an inner most end of the stacked array;

g. biasing means disposed and inter-connected between said support platform and said container and disposed and structure for biasing a plurality of tissues and support platform in a direction towards said exit means, h. securement means mounted on at least one sidewall of said container for support and securement of said biasing means to said container and extending inwardly into said hollow interior thereof, i. anchor means formed and on said securement means and structure for fixed attachment of said securement means to said one sidewall, and j. said securement means comprising a finger protruding into said hollow interior and having an enlarged head portion mounted on an inner extremity, said biasing means having one end supported on said finger in board of said enlarged head portion.

2. An assembly as in claim 1 wherein said biasing means comprises at least one elongated band member formed from a flexible, elastic material and interconnected between a securement structure disposed at least partially within said hollow interior and said support platform.

3. An assembly of claim 1 wherein said biasing means comprises two elongated band elements each supported on an inner surface portion of a different one of two opposing side walls and each band element extending therefrom into connected and supporting relation with said support platform.

4. An assembly as in claim 1 wherein said biasing means comprises two elongated spring members each supported on inner surface portions of a different one of two opposing side walls and each band element extending therefrom into connected and supporting relation with said support platform.

5. An assembly as in claim 4 wherein each of said spring members comprises opposite end portions dimensioned and configured to be connected respectively to said securement structure and said support platform; said spring member further comprising an extendable mid-portion connected to each of said end portions.

6. An assembly as in claim 5 wherein each of said end portions comprises a substantially closed loop configuration and each of said spring members being formed from a metallic material.

7. An assembly as in claim 1 wherein said anchor means comprises a washer element engaging an outer most end of said finger in supporting engagement with said one side wall.

8. An assembly as in claim 1 wherein said anchor means comprises a deformable flange integrally formed on an outer end of the finger and disposable into locking engagement with a correspondingly positioned surface of said one side wall.

9. An assembly as in claim 1 wherein said exit means comprises an aperture integrally formed on said end wall and being dimensioned and configured to allow passage therethrough of individual ones of the plurality of tissues.

10. An assembly of claim 1 wherein each of said mounting members comprises a base portion securable to an exterior surface of said container and extendable into an interior portion of said respective mounting member and including a biasing spring disposed in engaging relation with said base portion and normally biasing said base portion outward from the remainder of said respective mounting member.

11. An assembly as in claim 1, wherein said exit means includes an exit aperture integrally formed in said endwall, said endwall defining a bottom wall of the container when said container is its operative position and supported in the roll supporting structure.

* * * * *